United States Patent [19]

Bridges

[11] 4,239,270

[45] Dec. 16, 1980

[54] KEY-REMINDER AUTOMOTIVE DOOR LOCKING SYSTEM

[76] Inventor: Thomas L. Bridges, Box 345 Mohonk Rd., High Falls, N.Y. 12440

[21] Appl. No.: 930,735

[22] Filed: Aug. 3, 1978

[51] Int. Cl.[3] ..... E05C 21/00

[52] U.S. Cl. ..... 292/347; 292/1

[58] Field of Search ..... 292/1, 347, 336.3

[56] References Cited

U.S. PATENT DOCUMENTS

| | | | |
|---|---|---|---|
| 2,874,988 | 2/1959 | Sage et al. | 292/347 |
| 3,247,691 | 4/1966 | Martin | 292/1 X |
| 3,623,758 | 11/1971 | Trinca | 292/347 |
| 3,999,788 | 12/1976 | Livingston | 292/347 |
| 4,098,529 | 7/1978 | Bingham | 292/347 |

*Primary Examiner*—Richard E. Moore

*Attorney, Agent, or Firm*—Heslin, Irwin & Nieman

[57] ABSTRACT

The operating rod of an automotive door lock is provided with a connector member which, in turn, is engaged by a knob having a cavity to receive the connector member. The outside dimensions of the knob are larger than the aperture in the casing, thus preventing the knob from being depressed. The cavity in the knob is sufficiently large to permit the connector member and thus, the rod, to be in its advanced, or unlocked position, while remaining entirely within the knob. This arrangement permits one to pull upwardly on the knob thereby unlocking the door, but prevents one from manually depressing the knob or the connector member and thus, the rod, to thereby lock the door. A car key, however, can be inserted through the top of the cavity to urge the connector member and the rod to the retracted, locked position.

20 Claims, 2 Drawing Figures

KEY-REMINDER AUTOMOTIVE DOOR LOCKING SYSTEM

BACKGROUND OF THE INVENTION

This invention relates to automotive door locking mechanisms and, more specifically, it relates to a novel knob system for such mechanisms.

Most automobiles being manufactured today are provided with door locks which can be operated by means of a knob located on the inside of the door. These mechanisms can, of course, be operated from the outside with keys provided for the driver's door and the opposite door.

With one of the popular types of locking systems used presently, it is possible to lock each door of an automobile by simply depressing the operating knob and closing the door. Because of this method of operation, it is relatively each for a driver to inadvertantly lock his keys inside of his automobile. While such locking mechanisms are quite satisfactory in other respects, this particular feature is undesirable.

SUMMARY OF THE INVENTION

It is an object of this invention to provide a knob system which will have a mode of operation tending to substantially reduce the probability that a driver will inadvertantly lock his keys in his automobile or that the door of the automobile would be locked by a child or an animal inside the vehicle.

It is a further object of this invention to provide such a knob system in a form which can readily be used to replace the conventional knob commonly provided with automotive locking systems in order to secure the advantages of this invention.

This invention involves the use of a connector member attached to the operating rod found on conventional locking systems and a knob having a cavity for receiving and containing the connector member. The knob is larger in size than the aperture normally provided in the door casing and the cavity is sufficiently large to permit the connector member to travel between the rod's advanced, unlocked position and the retracted, locked position while the knob rests against the aperture.

BRIEF DESCRIPTION OF THE DRAWINGS

In FIG. 1 the invention is shown protruding upwardly through door casing 10, shown in fragmentary form. Fragmentary portions of door frame 12, window 14 and the outer surface 16 of a conventional automotive door are shown.

Figure 2:
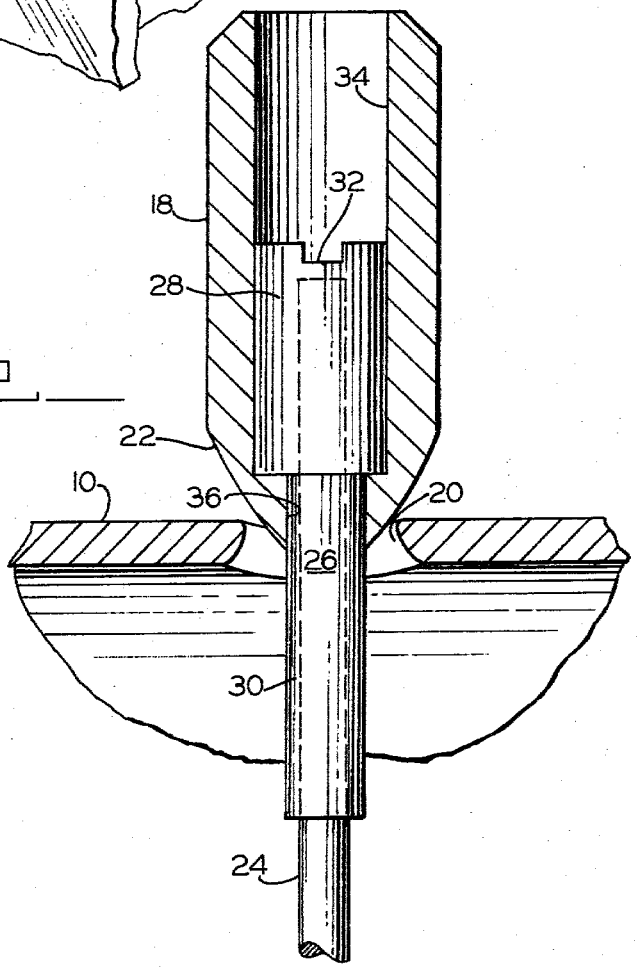
FIG. 2 is a cross-sectional view of the invention taken in a plane perpendicular to the slot in the head of the connecting member with the operating rod in the locked position.

Knob 18 is depicted in the conventional location for operating the locking mechanism of the door. As shown, door casing 10 is provided with an aperture 20 through which a conically tapered section 22 of knob 18 passes. As best illustrated in FIG. 2, however, knob 18 is too large in its exterior dimensions to pass through aperture 20.

Figure 1:
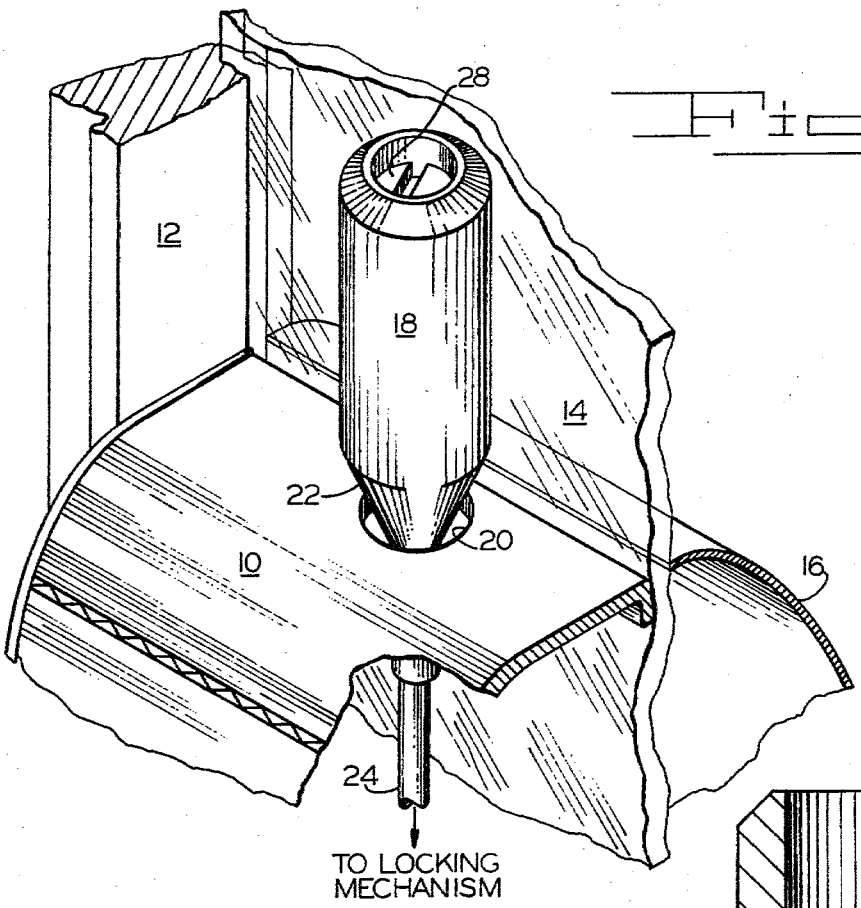
FIG. 1 is a perspective view of the invention showing the operating rod of the locking system in its unlocked position.

Conventional locking systems are generally operated by means of a rod 24. To lock the door, the rod would be pushed downwardly, in the sense of FIGS. 1 and 2, into its retracted position. To unlock the door, the rod 24 would be pulled upwardly into its advanced position.

Attached to rod 24 is a connector member 26. The connector member shown is provided with a head 28 and a relatively narrower neck 30. Slot 32 in head 28 is large enough to accommodate the blade of a screwdriver. The interior of connector member 26 may be threaded for attachment to rod 24, should rod 24 be threaded. Of course, connector member 26 can be attached to rod 24 in any other convenient way.

A cavity 34 is formed within the interior of knob 18. Cavity 34 communicates with a channel 36. Head 28 is slideably fit within cavity 34 and, as shown, is too large to pass through channel 36. Neck 30 is slideably fit through channel 36.

The rod in FIG. 2 is shown in its retracted, or locked, position. It can be operated to its advanced, or unlocked, position by drawing it upwardly in the conventional fashion by grasping knob 18 and exerting an upward force. It will be appreciated, however, that connector member 26 and rod 24 cannot be depressed into the retracted, or locked, position in the usual manner of pushing knob 18 downwardly with one's thumb. This is because knob 18 cannot pass through aperture 20 and the cavity 34 is too narrow to accommodate one's finger. Thus, in order to urge connector member 26 and rod 24 into the retracted position, it is necessary to insert an object such as a car key into cavity 34. This will very likely cause the operator of an automobile to have his car keys in hand upon the locking of the motor vehicle.

A conventional operating knob (not shown) would typically be threaded to rod 24. In order to install connector member 26 and knob 18, one would first unscrew and remove the conventional knob. Next, connector member 26 would be inserted in knob 18. Then, employing a screwdriver, connector member 26 would be attached to rod 24. Connector member 26 would be screwed downwardly until knob 18 became lightly pressed against aperture 20 while the rod 24 is in its retracted position.

Clearly, one could make a number of modifications to this invention while achieving the same results. For example, a connector member 26 could be provided without neck 30 if rod 24 is sufficiently long to engage head 28 within cavity 34. Neck 30, however, is needed where rod 24 is too short for this. In some instances, it might be necessary to remove a portion of rod 24 where it is too long, thereby preventing connector member 26 to be screwed down sufficinetly, as described above. Also, it is not particularly critical that the fit between cavity 34 and head 28 be held to close tolerances, so long as the two can slide with relation to one another. Of course, the looser the fit, the more knob 18 will be permitted to wobble. Likewise, there is no particular need to shape cavity 34 as a cylinder, as shown. For example, cavity 34 could be shaped with four or more flat walls and head 28 could have a corresponding shape. However, with such a configuration, it would be possible to cause the invention to become maladjusted merely by the rotation of knob 18, assuming connector member 26 is threaded to rod 24. With a cylindrical shaping of these parts and a sufficiently loose fit between knob 18 and connector member 26, rotation of knob 18 would not have this effect.

Knob 18 and connector member 26 may be formed in any suitable material. Plastic may be conveniently used since it can be mass produced through conventional molding processes.

It is intended to encompass all modifications such as those mentioned in the proceding paragraphs within the scope of the following appended claims.

What is claimed is:

1. In an improved locking of the type having a door lock mounted in a door casing, said door lock being of the type having a rod operable between an advanced and a retracted position through an aperture in the door casing, the improvement comprising:

a knob having a top and a bottom and having outside dimensions larger in size, at least near its bottom, than the casing aperture so as to substantially prevent its entry into the casing, and also having a bore therein for receiving a connector member, said bore having a cavity communicating with a relatively narrower channel opening at the bottom of the knob, said cavity having an opening at the top of the knob so as to provide access to the interior of the knob; and a connector member slideably fit within the cavity, said connector member being attached to the rod through the channel, but being too large to pass therethrough, the depth of the cavity being sufficient to permit movement of the connector member with the rod from its retracted position to its advanced position without protruding substantially through the top of the knob even when the bottom of the knob is in contact with the door casing.

2. The invention of claim 1 wherein the attachment of the connector member is such that the knob is held against the casing aperture when the rod is in its retracted position.

3. The invention of claim 2 wherein the cavity is of sufficient depth to permit the connector member to be contained therein when the rod is in its advanced position.

4. The invention of claim 2 wherein the connector member includes a neck adapted to extend through the channel opening for connection with the rod and a head loosely fit within the cavity, said head being too large to pass through the channel opening.

5. The invention of claim 4 wherein the knob is generally cylindrical in its exterior shape and wherein the cavity, channel opening and head are cylindrically shaped.

6. The invention of claim 5 wherein the cavity communicates directly with the exterior of the knob and wherein the cavity is large enough to permit the insertion of an automotive key to urge the head and rod to the retracted position.

7. The invention of claim 6 wherein the knob is concially shaped where it meets the aperture.

8. The invention of claim 1 wherein the connector member is threaded for attachment to the rod.

9. A method or providing a key-reminder knob system for use with a door lock mounted in a door casing, said door lock being of the type having a rod operable between an advanced and a retracted position through an aperture in the door casing comprising the steps of:

forming a knob having a top and a bottom and having outside dimensions larger in size, at least near its bottom, than the casing aperture so as to substantially prevent its entry into the casing, and also having a bore with a cavity for receiving a connector member and a channel opening at the bottom of the knob communicating with the cavity and being narrower than the connector member, said cavity having an opening at the top of the knob so as to provide access to the interior of the knob; and forming a connector member adapted to slideably fit within the cavity and further adpated to be connected to the rod through the channel opening, the depth of the cavity being sufficient to permit movement of the connector member with the rod from its retracted position to its advanced position without protruding substantially through the top of the knob even when the bottom of the knob is in contact with the door casing.

10. A door locking system operable through an aperture in the door comprising:

a locking mechanism on one said of the aperture having a rod operable between an advanced and a retracted position;

a knob on the other side of the aperture, said knob having a top and a bottom and having outside dimensions larger, at least near its bottom, than the aperture so as to substantially prevent its entry into the casing, and said knob having a cavity therein for receiving a connector member, said cavity communicating with a relatively narrower channel opening on the bottom of said knob, said cavity having an opening at the top of the knob so as to provide access to the interior of the knob; and a connector member slideably fit within the cavity, said member being attached to the rod through the channel opening but being too large to pass through the channel opening, the depth of the cavity being sufficient to permit movement of the connector member with the rod from its retracted position to its advanced position without protruding substantially through the top of the knob even when the bottom of the knob is in contact with the door at the aperture.

11. The invention of claim 10 wherein the attachment of the connector member is such that the knob is held against the casing aperture when the rod is in its retracted position.

12. The invention of claim 11 wherein the cavity is of sufficient depth to permit the connector member to be contained therein when the rod is in its advanced position.

13. The invention of claim 11 wherein the connector member includes a neck adapted to extend through the channel opening for connection with the rod and a head loosely fit within the cavity, said head being too large to pass through the channel.

14. The invention of claim 13 wherein the knob is generally cylindrical in its exterior shape and wherein the cavity, channel opening and head are cylindrically shaped.

15. The invention of claim 14 wherein the cavity communicates directly with the exterior of the knob and wherein the cavity is large enough to permit the insertion of an automotive key to urge the head and rod to the retracted position.

16. The invention of claim 15 wherein the knob is conically shaped where it meets the aperture.

17. The invention of claim 10 wherein the connector member and the rod are threaded for attachment with one another.

18. A method of providing a keyreminder door locking system operable through an aperture in the door comprising the steps of:

mounting a locking mechanism substantially on one side of the aperture, said mechanism being of the type having a rod operable between an advanced and retracted position;

placing a knob having a top and a bottom on the other side of the aperture, said knob being too large, at least near its bottom, to enter into the aperture substantially, and said knob having a cavity therein for receiving a connecting member, said cavity communicating with a relatively narrower channel opening at the bottom of the knob and said cavity having an opening at the top of the said kob so as to provide access to the interior of the knob;

inserting a connecting member in the cavity, said connecting member being too large to pass through the channel opening; and attaching the connecting member to the rod through the channel opening so that the bottom of the knob is drawn against the aperture when the rod is in its retracted position, the depth of the cavity being sufficient to permit movement of the connector member with the rod from its retracted position to its advanced position without protruding substantially through the top of the knob even when the bottom of the knob is in contact with the door at the aperture.

19. The method of claim 9 comprising the additional step of:

providing means for adjusting the point of connection of the connector member to the rod.

20. The method of claim 19 comprising the additional step of:

adjusting the connection of the connector member so that the knob is held against the casing aperture when the rod is in its retracted position.

* * * * *